US005381891A

United States Patent [19]

Harris

[11] Patent Number: 5,381,891

[45] Date of Patent: Jan. 17, 1995

[54] WRAP-AROUND CARRIER WITH END STRAPS

[75] Inventor: Randall L. Harris, Powder Springs, Ga.

[73] Assignee: Riverwood International Corporation, Atlanta, Ga.

[21] Appl. No.: 194,763

[22] Filed: Feb. 10, 1994

[51] Int. Cl.[6] ..... B65D 75/00

[52] U.S. Cl. ..... 206/197; 206/141; 206/427; 206/428

[58] Field of Search ..... 206/139, 140, 141, 142, 206/193, 197, 427, 428, 429, 434

[56] References Cited

U.S. PATENT DOCUMENTS

| | | | |
|---|---|---|---|
| 2,527,478 | 10/1950 | Gray | 206/197 |
| 2,558,714 | 6/1951 | Williamson | 206/193 |
| 2,605,034 | 7/1952 | Williamson | 206/428 |
| 3,123,214 | 3/1964 | McReynolds, Jr. | 206/434 |
| 3,395,791 | 8/1968 | Graser | 206/434 |
| 3,451,543 | 6/1969 | Graser et al. | 206/434 |
| 3,688,969 | 9/1972 | Gabarez | 206/139 |
| 3,750,874 | 8/1973 | Detzel et al. | 206/141 |
| 3,977,518 | 8/1976 | Arneson | 206/141 |
| 4,424,901 | 1/1984 | Lanier | 206/141 |
| 5,060,792 | 10/1991 | Oliff | 206/427 |

*Primary Examiner*—David T. Fidei

[57] ABSTRACT

A wrap-around carrier containing means for covering the pricing code on the end articles in the package. Straps connected to the side panels extend between the end articles and the side panels and across the end of the carrier to both conceal the article price code and to act as a restraint against outward movement of the articles. The straps are formed from cutouts in the top and side panels of the carrier, leaving a handle strip in the top panel.

7 Claims, 2 Drawing Sheets

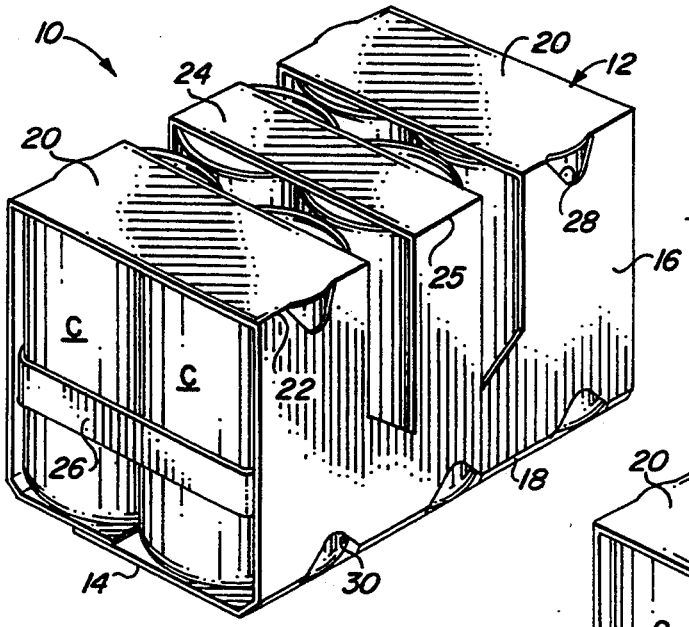
FIG. 1
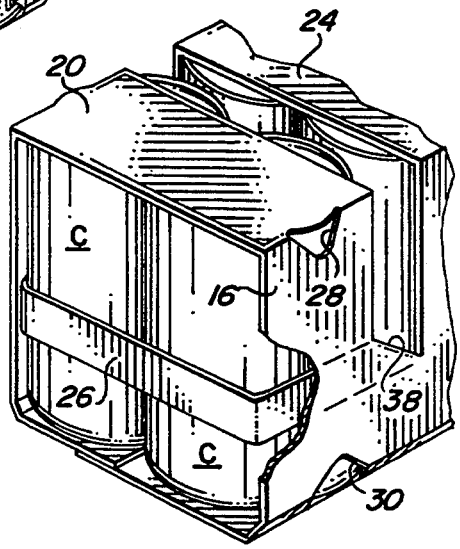
FIG. 5
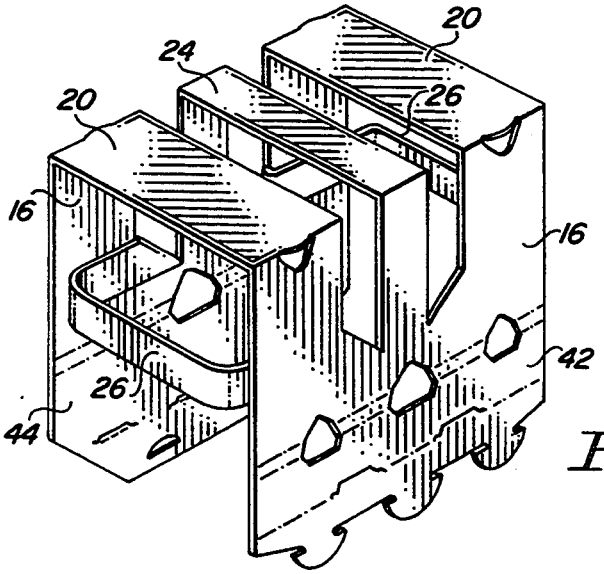
FIG. 4
FIG. 3
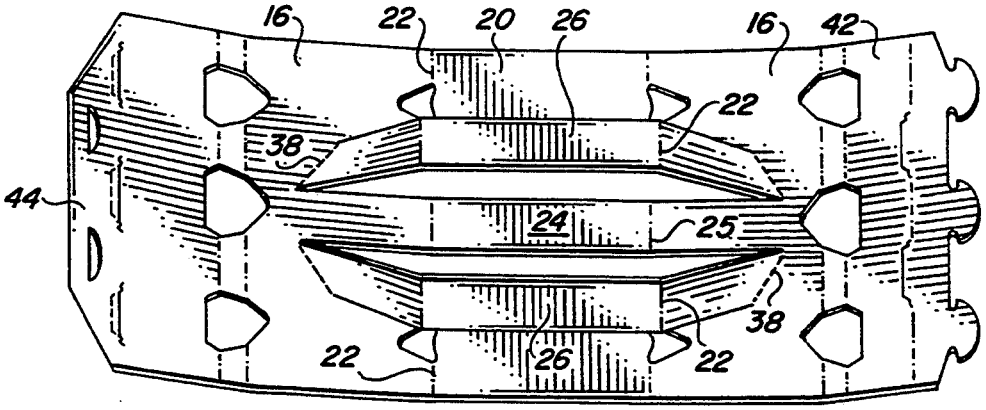

WRAP-AROUND CARRIER WITH END STRAPS

FIELD OF THE INVENTION

This invention relates to wrap-around article carriers. More particularly, it relates to wrap-around carriers which are capable of blocking the price code printed on the articles.

BACKGROUND OF THE INVENTION

Certain types of articles, such as food or beverage containers, are commonly sold either as individual units or in a multi-container carton. Each article is normally marked with a pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

Instead of utilizing fully enclosed carriers it has been suggested to employ modified wrap-around carriers having partial end panels of a size sufficient to cover the pricing code on the end articles in the package. Such a design, although requiring less stock than a fully enclosed carrier, still results in the use of a significant amount of additional stock over the amount required for an open-ended wrap-around carrier and is more expensive than a conventional wrap-around carrier. Another suggestion is to first cover the pricing code on the individual articles with paperboard before wrapping the articles. This too is unsatisfactory because it requires a greater amount of paperboard than an open-ended wrap-around carrier.

It would be highly desirable to be able to package articles in wrap-around carriers which utilize no more paperboard stock than conventional open-ended wrap-around carriers, yet are capable of covering the pricing code on the end articles.

BRIEF SUMMARY OF THE INVENTION

The wrap-around carrier of the invention solves the packaging problem by incorporating a strap at each end of the carrier. Each strap is foldably connected at its ends to the opposite side panels and is located so as to cover the pricing code on adjacent articles in the carrier.

In a preferred embodiment the blank from which the carrier is formed includes two pairs of spaced parallel slits, with the straps being formed from the material between the pairs of slits. In such an arrangement end portions of the straps lie between an adjacent article and a side panel, and the central portion of the straps extends between the side panels. The side panels of the carrier contains cutouts extending from either the top or bottom panel to the end of a connected strap, each cutout corresponding in shape and size to the end portion of the connected strap. Cutouts in the top or bottom panel correspond in shape and size to the central portion of the straps. Preferably, cutouts are formed in the top panel, and the portion of the top panel between the cutouts functions as a handle.

The end straps not only cover the pricing codes on the end articles but also act as end restraints to prevent end articles in the package from falling out. The carrier is formed from a single generally rectangular blank, and is considerably more economical to produce than fully or partially enclosed carriers.

The above and other aspects and benefits of the invention will readily be apparent from the more detailed description of the preferred embodiment of the invention which follows.

BRIEF DESCRIPTION OF THE DRAWING

FIG. 1 is a pictorial view of the wrap-around carrier of the invention illustrated as part of a package containing six beverage cans;

FIG. 3 is a pictorial view of the interior of the carrier blank showing the end straps after they have been folded out of the plane of the blank;

FIG. 4 is a pictorial view of the folded blank prior to applying it to the cans; and FIG. 5 is an enlarged pictorial view of a corner the carrier, with a portion of the corner broken away to show the relationship of the end carrier strap and the adjacent article.

DETAILED DESCRIPTION OF THE PREFERRED EMBODIMENT

Figure 2:
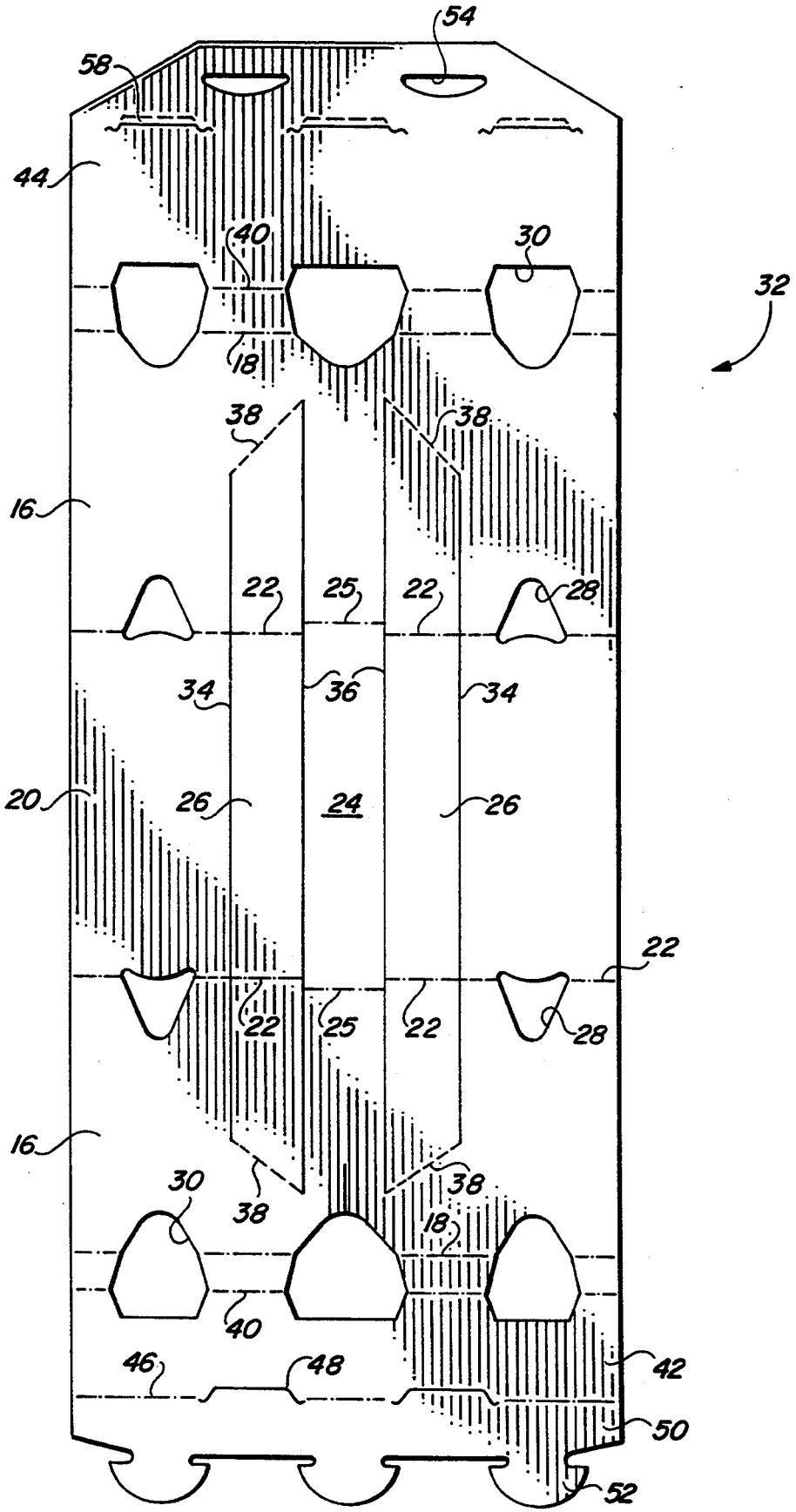
FIG. 2 is a plan view of a blank for forming the carrier of FIG. 1.

Referring to FIG. 1, a package 10 is comprised of a wrap-around carrier 12 containing six abutting beverage cans C supported on bottom panel 14. Side panels 16 are connected to the bottom panel along fold lines 18 and to end portions of the top panel 20 along fold lines 22. In addition to the end portions 20, the top panel is comprised of a centrally located carrying handle or strap 24 which is spaced from the end sections and connected to the side panels along fold lines 25. The gaps or spaces between the end sections 20 and the handle strap 24 are continued into the side panels for a substantial distance. The dimensions of the side panel gaps are discussed further below.

End straps 26, extending from one side panel to the other, tightly engage the end cans in the package and are located so that the pricing code on the end cans is covered. Openings 28 in the upper portion of the side panels adjacent the top panel sections 20 allow adjacent can chimes to extend out slightly beyond the top panel sections, which enables the side panels to be drawn tightly against the cans when the wrapper is applied. Openings 30 in the lower portion of the side panels extend into the bottom panel and allow the bottom portions of adjacent cans to be more tightly gripped by the bottom and side panels.

Referring now to FIG. 2, wherein like reference numerals to those used in FIG. 1 denote like elements, a blank 32 capable of being fabricated into the carrier of FIG. 1 includes centrally located top panel sections 20 and adjacent side panel sections 16. A series of parallel slits extend through the central portion of the blank and into the side panel sections to form the handle and the end straps. Thus slits 34 separate the top panel sections 20 from the end straps 26 and slits 36 separate the end straps 26 from the handle strap 24. The slits 36 extend into the side panel sections 16 a greater distance than the slits 34, and the ends of the slits 36 are connected to the ends of the slits 34 by angled fold lines 38. The fold lines 22 extend across the straps 26, terminating at the slits 36. The fold lines 25 extend across the strap 24 and are slightly offset from the fold lines 22 toward the ends of the blank.

Preferably, additional fold lines 40 are provided outwardly from and parallel to the fold lines 18 so as to form a short sloped panel section between the side panels and the bottom panel of the carrier in order to more readily receive the bottom portions of the cans in the openings 30. Connected to the fold lines 40 at opposite ends of the blank are bottom panel flaps 42 and 44. The bottom panel flap 42 includes a fold line 46 which extends the full length of the flap and which is interrupted by primary male locking tabs 48. The portion 50 of the flap 42 lying outwardly of the fold line 46 constitutes a locking panel which includes secondary male locking tabs 52. The bottom panel flap 44 includes primary female locking edges 54 adapted to engage the primary male locking members 48 and slits 56 adapted to receive the secondary locking tabs 52. Tabs 58 may be foldably connected to the bottom panel flap 44 a short distance outwardly of the slits 56 to facilitate entry of the locking tabs 52 into the slits. Although these various locking elements are illustrated to demonstrate a typical bottom panel locking arrangement suitable for use with the carrier of the invention, it should be understood that any desired effective form of bottom panel locking means may be employed.

To form a package of articles, assuming the surface of the blank shown in FIG. 2 is to be the outer surface of the carrier, the straps 26 are punched down and pivoted about their fold lines 38 while the side panel sections 16 are folded down about the fold lines 22. The initial phase of folding the straps in this manner is illustrated in FIG. 3, which shows that when the straps are folded in this manner the original outer surface of the straps faces the interior of the package and the original underside of the straps faces outwardly. The folding of the straps and the side panel sections continues until the side panels are substantially at right angles to the top panel, with the end straps 26 extending between opposite side panels. The blank at this stage of fabrication is illustrated in FIG. 4. The folded blank of FIG. 4 is then slid over a group of adjacent articles and the bottom panel flaps are locked together. The details of the locking phase of the operation have not been illustrated since the particular locking mechanism employed does not form part of the invention. It will be understood by those familiar with the locking elements shown, however, that the outer flap portion or locking panel 50 of the bottom panel flap 42 is folded back about the fold line 46 and the primary male locking tabs 48 are engaged with the primary female locking edges 54 in bottom panel flap 44. The secondary male locking tabs 52 are then inserted through the slits 56 to complete the mechanical locking action, resulting in the package of FIG. 1.

As shown in FIG. 5, the portion of the end straps in the finished package between the fold lines 22 and 38 lies between the side panel 16 and the adjacent can C. The pressure of the adjacent cans clamps these strap portions in place, enabling the portion of the strap at the end of the package to function as an end restraint as well as to cover the pricing code on the end cans. The central portion of the side panels extending down from the carrying handle 24 effectively covers the pricing code on the interior cans.

As noted above, the end straps are connected to the side panels by the angled fold lines 38. The illustrated angle is at 45° to the plane of the top and bottom panels, which permits the straps to be folded in the manner described while leaving a maximum of material in the side panels for strength. Although this angle may be varied as necessary, it should include a component which is parallel to the top and bottom panels to promote the initial folding out of the plane of the blank. It should also include a component which is at right angles to the top and bottom panels to permit the strap to fold out to its final position. It will be understood that the location of the fold lines 38 relative to the bottom panel is dependent upon the location of the pricing code on the articles.

The presence of the fold lines 22 in the end straps 26 is not essential to the formation of the carrier, but is preferred since it encourages the outward folding action of the straps when the carrier is formed as described above. In addition, the dimensions of the strap cause the fold lines 22 to be located at the end of the adjacent side panel so that the length of the end portion of the strap is substantially equal to the width of the carrier. This arrangement contributes to the tight fit discussed above which enables the end straps to also function as article end restraints.

The width of the end straps may vary as desired, provided that it readily covers the price code on the end articles and is not so wide that the resulting gaps in the side panels excessively weaken the carrier. The handle strap 24 must also be sufficiently wide to withstand the stresses of lifting and carrying the package.

As illustrated in FIG. 2, the fold lines 25 are slightly offset from the fold lines 22, making the carrying handle strap 24 slightly longer than the width of the carrier. This is primarily to compensate for the fact that the handle strap does not contain cutouts similar to cutouts 28. Therefore, the fold lines 25 are located so as to correspond to the location of the can chimes, which in the side panels are located slightly outwardly of the fold lines 22. When the carrier is lifted by the handle the resulting slight upward bowing of the handle moves the fold lines 25 in so that during lifting they are essentially in the same plane as the side panels.

It should now be apparent that the invention provides a means for covering the price code of end articles in a wrap-around carrier without adding additional blank material in order to accomplish it. The design results in further benefits, including the ability of the end straps to function as end restraints and the provision of a handle.

It will be understood that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. A package comprised of a wrap-around carrier containing a plurality of articles, comprising:

opposite side panels connected to a bottom panel;

a top panel having end portions and a central portion, the end portions and the central portion having side edges;

the side edges of the end portions of the top panel and the side edges of the central portion of the top panel being connected by fold lines to the side panels, the end portions and central portion of the top panel extending at substantially right angles to the side panels;

the central portion of the top panel being separated from each end portion thereof by a cutout extending across the width of the top panel and into the side panels for a substantial distance, each cutout terminating in opposite side panels at fold lines connecting opposite ends of an end strap to the side panels;

the fold lines connecting the end straps to the side panels extending outwardly and upwardly at an angle to the top and bottom panels;

the end straps having a central portion corresponding in shape and size to the top panel cutouts and being unconnected to and spaced from the associated end portion of the top panel, the central portion of the end straps extending between the side panels and being adjacent at least some of the articles in the carrier;

the end straps including end portions lying between said adjacent articles and the associated side panels; and the central portion of the top panel comprising a handle strap to be grasped by the hand of a user in order to lift the package.

2. A package as defined in claim 1, wherein the distance between the side edges of the central portion of the top panel is greater than the distance between the side edges of the end portions of the top panel.

3. A package as defined in claim 2, wherein the articles are cans and the top panel is adjacent the tops of the cans.

4. A package as defined in claim 1, wherein the portions of the articles covered by the end straps include pricing codes.

5. A package as defined in claim 3, wherein the side panels include cutouts adjacent the fold lines connecting the side panels to the end portions of the top panel.

6. A generally rectangular blank for forming a wrap-around carrier for packaging a plurality of articles, comprising:

a centrally located top panel section connected along opposite fold lines to side panel sections;

the side panel sections being connected along fold lines to bottom panel flaps which are connected to each other in a carrier formed from the blank;

two pairs of substantially parallel slits extending across the top panel section and terminating in the side panel sections;

angled fold lines in each side panel section connecting the ends of the slits of each pair;

the area defined by each pair of slits and the associated angled fold lines being foldable along the angled fold lines to form end straps in a carrier formed from the blank;

the portion of the top panel section between the two pairs of parallel slits comprising a handle strap in a carrier formed from the blank; and the distance between the fold lines connecting the handle strap portion of the top panel section to the side panel sections being greater than the distance between the fold lines connecting other portions of the top panel section to the side panel sections.

7. A blank as defined in claim 6, wherein the side panel sections include cutouts adjacent the fold lines connecting the side panel sections to said other portions of the top panel section.

* * * * *